US011254476B1

(12) United States Patent
Weng

(10) Patent No.: US 11,254,476 B1
(45) Date of Patent: Feb. 22, 2022

(54) LOCKING LID

(71) Applicant: WUYI PENGSHENG INDUSTRIAL & TRADE CO., LTD, Wuyi (CN)

(72) Inventor: Huaze Weng, Wuyi (CN)

( * ) Notice: Subject to any disclaimer, the term of this patent is extended or adjusted under 35 U.S.C. 154(b) by 0 days.

(21) Appl. No.: 17/127,507

(22) Filed: Dec. 18, 2020

(51) Int. Cl.
*B65D 50/06* (2006.01)
*B65D 43/02* (2006.01)
*B65D 47/20* (2006.01)

(52) U.S. Cl.
CPC ..... *B65D 50/06* (2013.01); *B65D 43/0235* (2013.01); *B65D 47/2006* (2013.01); *B65D 2255/00* (2013.01)

(58) Field of Classification Search
CPC ..... B65D 51/18; B65D 51/242; B65D 2251/1058; B65D 25/38; B65D 2215/04; B65D 2251/1066; B65D 47/08; B65D 47/121; B65D 43/22; B65D 2543/00046; B65D 43/02; A47J 41/0022
See application file for complete search history.

(56) References Cited

U.S. PATENT DOCUMENTS

| | | | | |
|---|---|---|---|---|
| 7,275,653 | B2 | 10/2007 | Tedford, Jr. | |
| 7,513,380 | B2 | 4/2009 | Canedo | |
| 8,353,419 | B2 | 1/2013 | Jung | |
| 8,727,176 | B2 | 5/2014 | El-Saden | |
| 9,282,383 | B2 | 3/2016 | Sims | |
| 10,023,366 | B2 | 7/2018 | Gilbert et al. | |
| 10,167,120 | B1 | 1/2019 | Levy et al. | |
| 10,421,587 | B2 * | 9/2019 | Gilbert | A47G 19/2272 |
| 2004/0040962 | A1 * | 3/2004 | Bielecki | A47G 19/2288 220/254.1 |
| 2005/0040175 | A1 * | 2/2005 | Stephens | B65D 47/061 220/705 |
| 2012/0234789 | A1 * | 9/2012 | Mason | B65D 47/36 215/229 |
| 2020/0148431 | A1 * | 5/2020 | Tsai | B65D 51/242 |

FOREIGN PATENT DOCUMENTS

| | | |
|---|---|---|
| JP | 3913227 | 5/2007 |

* cited by examiner

*Primary Examiner* — Shawn M Braden
(74) *Attorney, Agent, or Firm* — Clement Cheng

(57) ABSTRACT

A vessel with a locking lid has a spindle button. The spindle but has downwardly facing button teeth. The lid frame receives the spindle button in a vertical sliding configuration. The actuator gear is mounted under the spindle button in the lid frame. The actuator gear engages the downwardly facing button teeth. The spindle button is configured to move the actuator gear by one step when the spindle button is pressed down. A lid frame inside surface has an upper engagement and a lower engagement. The actuator gear is configured to alternate between the upper engagement and the lower engagement when the actuator gear moves by one step. A spindle body abuts and is biased upwardly against the actuator gear. The spindle body actuates locking arms mounted on locking arm pivots formed on the spindle body.

17 Claims, 6 Drawing Sheets

LOCKING LID

FIELD OF THE INVENTION

The present invention is in the field of insulated locking lids.

DISCUSSION OF RELATED ART

Traditionally, beverage containers have used screw cap or cork closure lids. The traditional beverage container requires two hands to open because it relies on a threaded connection or interference fit.

For example, in U.S. Pat. No. 10,167,120 entitled Travel bottle with twisting locking lid by inventor Gordon Levy et al., published Jan. 1, 2019 the abstract discloses, "A bottle includes a secure sealing mechanism. A twisting locking lid secured onto a bottle maintains the contents of the bottle. This is achieved by securing a dispensing mechanism in a closed, locked position and sealing an outlet so that any liquids being forced into a dispensing channel are held within the channel."

Also for example, in U.S. Pat. No. 9,282,838 entitled Lockable beverage container closure by inventor Randy Sims, published Mar. 15, 2016 the abstract discloses, "A beverage container closure or lid that is adapted for closing an open end of a beverage container is provided. The lid is selectively couplable to the beverage container and includes a selectively openable cover that, when closed, creates a fluid-tight seal between the beverage container and the environment. The lid is provided with a dual-locking mechanism including an actuation disk locking mechanism and a press-button locking mechanism. Each locking mechanism is operable to transition between a locking position and an unlocking position and opening the cover to permit the passage of fluid requires that both locking mechanism be in their respective unlocking positions."

For example, in U.S. Pat. No. 10,023,366 entitled Beverage container closure by inventor Tyler Sean GILBERT, published Jul. 17, 2018 the abstract discloses, "A beverage container closure or lid that is adapted for closing an open end of a beverage container. The lid is selectively couplable to the beverage container and includes a selectively openable stopper that when closed, creates a fluid-tight seal between the beverage container and the environment. The stopper may be selectively opened by a user by the user pressing a button disposed on a side of the beverage container closure. The stopper is subsequently automatically closed when the user releases the button. Thus, a user may open and close the beverage container closure using a single hand without the need to remove the beverage container closure from the beverage container." Also, for example, in U.S. Pat. No. 8,727,176 entitled Seal mechanism for beverage container by inventor Sami M. El-Saden et. al., published May 20, 2014 the abstract discloses, "A lid assembly for a beverage container having a lid housing, a seal assembly and a trigger member. The seal assembly has one or more drink seals that engage a corresponding one or more drink apertures to close the drink apertures. The seal assembly is rotatedly connected to the lid housing and movable between a use position and a cleaning position for cleaning. The trigger member is connected to the lid housing and is capable of engaging the seal assembly in the use position, but not in the cleaning position. The trigger member is connected to the seal assembly such that the vent aperture is opened during a first portion of the operation of the trigger, and the drink apertures are opened during a second portion of the operation of the trigger so that the vent aperture is opened before the drink apertures."

Also for example, in U.S. Pat. No. 10,167,120 entitled Travel bottle with twisting locking lid by inventor Gordon Levy et. al., published Jan. 1, 2019 the abstract discloses, "A bottle includes a secure sealing mechanism. A twisting locking lid secured onto a bottle maintains the contents of the bottle. This is achieved by securing a dispensing mechanism in a closed, locked position and sealing an outlet so that any liquids being forced into a dispensing channel are held within the channel."

For example, in U.S. Pat. No. 7,275,653 entitled Reclosable container lid by inventor Richard A. Tedford, Jr., published Oct. 2, 2007 the abstract discloses, "A reclosable lid for use with an open-top container is disclosed. The reclosable container lid comprises a cover including an annular top wall having a channel integrally formed therein. A drinking spout in the top wall is adapted to dispense the contents of the container. The reclosable lid uses a slide lock closure feature that prevents spillage during transportation of the open-top container and easy access for opening and drinking. The slide lock closure is configured to engage with the channel to slide longitudinally along the channel between a first position and a second position. In the first position, the slide lock closure opens the drinking spout and in the second position, the slide lock closure closes the drinking spout to inhibit dispensing the contents of the container."

For example, in U.S. Pat. No. 7,513,380 entitled Self closing container by inventor Robert Canedo, published Apr. 7, 2009 the abstract discloses, "A self closing container having inner and outer sleeves. Outer sleeve surrounds inner sleeve and can freely slide on inner sleeve by lifting outer sleeve or handle. When container is closed, lid covers magnets, mouth magnets, mouth magnet platform, and mouth platform. When closed, bar magnet component is positioned over mouth magnets which permits mouth cover to cover mouth. When outer sleeve is raised, it raises ring in lid. In raised position, lid cover magnets on ring are repelled by corresponding magnets on lid cover. When ring is raised, mouth magnet platforms are raised. Mouth magnet platforms have two mouth magnets, one positioned toward mouth and one positioned toward back of the lid. When raised, mouth cover is moved backward to an open position with the use of the bar magnet component. When handle or outer sleeve is released all components return to their original positions effectively closing the container."

For example, in U.S. Pat. No. 8,353,419 entitled Lockable cap by inventor Richard Jung, published Jan. 15, 2013 the abstract discloses, "A lockable cap assembly including a handle having at least one protrusion, and a flip cap defining an internal chamber surrounded by a flip cap edge. The flip cap including at least one locking groove configured to engage the at least one protrusion, and an engagement surface. The lockable cap also including a collar having a release mechanism for engaging with the engagement surface. The flip cap being moveable between an open configuration in which a portion of the flip cap edge is not in contact with a surface of the collar and a closed configuration in which the flip cap edge is in full contact with the collar."

SUMMARY OF THE INVENTION

An object of the present invention is to provide a beverage container requiring only one hand to open, and does not require a threaded connection.

A vessel with a locking lid has a spindle button. The spindle but has downwardly facing button teeth. The lid frame receives the spindle button in a vertical sliding configuration. The actuator gear is mounted under the spindle button in the lid frame. The actuator gear engages the downwardly facing button teeth. The spindle button is configured to move the actuator gear by one step when the spindle button is pressed down. A lid frame inside surface has an upper engagement and a lower engagement. The actuator gear is configured to alternate between the upper engagement and the lower engagement when the actuator gear moves by one step. A spindle body abuts and is biased upwardly against the actuator gear. The spindle body actuates locking arms mounted on locking arm pivots formed on the spindle body.

The first locking arm is mounted to the spindle body at a first locking arm pivot formed on the spindle body. The second locking arm is mounted to the spindle body at a second locking arm pivot formed on the spindle body. A spring biases the spindle body upwardly. The vessel has a sidewall and a vessel inside indent formed on the vessel side wall. The vessel inside indent receives the first locking arm and the second locking arm when the first locking arm and the second locking arm are in an engaged position. The first locking arm and the second locking arm also have a disengaged position retracted away from the vessel inside indent.

The upper engagement is formed as a slot, and the lower engagement is formed as a protrusion. The actuator gear selectively engages the slot and protrusion. The actuator gear engages the slot in the disengaged position, and the actuator gear engages the protrusion in the engaged position. The lid frame has an upper body and a lower body. The upper body is connected to the lower body at a body junction. The lid frame has a first locking arm opening and a second locking arm opening. The first locking arm opening receives the first locking arm, and the second locking arm opening receives the second locking arm.

The lid frame has a lower body lower angle retainer and a lower body upper angle retainer. The lower body upper angle retainer defines a first locking arm angle when the locking arms are in a disengaged position. The lower body lower angle retainer defines a second locking arm angle when the locking arms are in an engaged position.

A spring retainer is mounted to the spindle body. The spring retainer retains an upper end of the spring. The spring is a helical spring wrapped around the spindle body. The spindle body is elongated, and the lid frame retains a lower end of the spring. The spring retainer is mounted below the actuator gear. The spring biases the spring retainer upwardly, which biases the spindle body upwardly, which biases the actuator gear upwardly, which biases the button upwardly.

The gasket is mounted on a gasket notch. The gasket notch is formed on the lid frame. The spindle seal is mounted to a spindle seal notch. The spindle seal notch is formed on the spindle. The lid frame has a lid hook handle with a latch gate. The latch gate is pivotally mounted to the lid frame. The lid hook handle is formed above the spindle button. The spindle button further includes a spindle button plug inserted into an underside of the spindle button to form an insulated button cavity between the spindle button plug and a button top of the spindle button. The protrusion has lower protrusion teeth for retaining angled teeth of the actuator gear.

The vessel is a double wall vessel having a vessel inside side wall inside a vessel outside side wall, with a vessel side wall cavity between the vessel inside side wall and the vessel outside side wall. The vessel inside indent is formed on the vessel inside side wall. The vessel has a shoulder and an elongated neck, and the lid frame fits within the elongated neck at the vessel opening.

The following call out list of elements can be a useful guide in referencing the element numbers of the drawings.

20 Lid
21 Upper Body
22 Lower Body
23 Body Junction
24 Lid Hook Handle
25 Latch Gate Hinge
26 Spindle Button
27 Spindle Button Plug
28 Locking Mechanism
29 Downward Button Motion
30 Vessel
31 Vessel Hollow
32 Vessel Shoulder
33 Vessel Neck
34 Vessel Opening
35 Vessel Inside Side Wall
36 Vessel Side Wall Cavity
37 Vessel Outside Side Wall
38 Vessel Lower Inside Indent
39 Vessel Lower Outside Indent
40 Locking Arms
41 Spindle Body
42 Vessel Inside Indent
43 Actuator Gear
44 Latch Gate
45 Insulated Button Cavity
46 Spring Retainer
47 Lid Frame
50 Actuator Gear Body
51 Upper Slots
52 Lower Protrusions
53 Upper Engagement
54 Lower Engagement
55 Angled Tooth
56 Gear Indent
57 Upper Slot Tooth
58 Lower Protrusion Tooth
59 Spindle Body Upper Tip

60 Gasket
61 Spindle Seal
62 Spindle Seal Notch
63 Gasket Notch
64 Spring Retainer
65 Helical Spring
66 Engaged Position
67 Disengaged Position
70 Locking Arms
71 First Locking Arm
72 Second Locking Arm
73 First Locking Arm Opening
74 Second Locking Arm Opening
75 First Locking Arm Pivot
76 Second Locking Arm Pivot
80 Locking Body
81 Hinge Pin
82 Torsion Spring
83 Unlocked Position
84 Locked Position
85 Locking Body Grip
86 Spindle Button Vertical Guides
87 Button Top
88 Button Tooth
89 Button Notch
90 Locking Arm Angle
91 Lower Body Lower Portion
92 Lower Body Spring Retainer
93 Lower Body Upper Angle Retainer
94 Locking Mechanism Angled Protrusion
95 Lower Body Lower Angle Retainer
96 Inside Surface Of Upper Body
97 Button Receiving Opening

DETAILED DESCRIPTION OF THE PREFERRED EMBODIMENT

Figure 1:
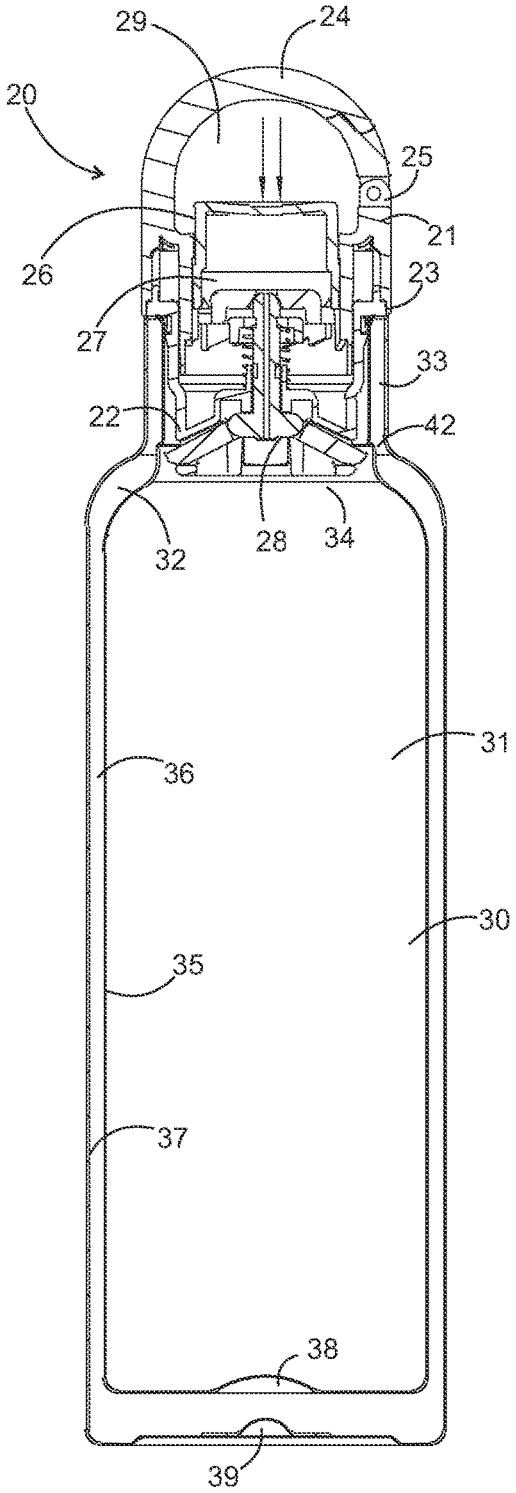
FIG. 1 is a cross-section diagram of the lid in a disengaged position on the vessel.
Figure 2:
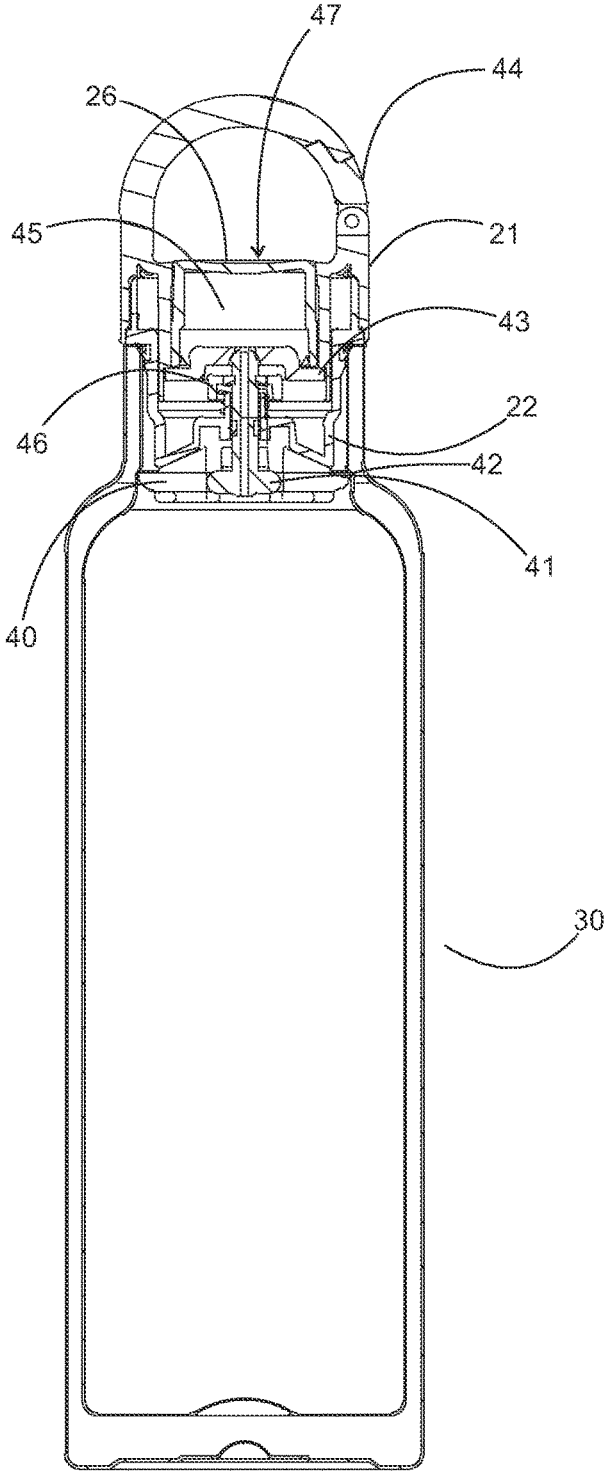
FIG. 2 is a cross-section diagram of the lid in an engaged position on the vessel.

As seen in FIGS. 1 and 2, the vessel 30 has a vessel hollow 31. The vessel hollow 31 is formed from a deep drawn metal sheet to be formed with a vessel side wall having a vessel inside side wall 35, a vessel outside side wall 37, and a vessel side wall cavity 36. On a lower portion of the vessel 30, the vessel inside side wall 35 can form a vessel lower inside indent 38, and the vessel outside side wall 37 can form a vessel lower outside indent 39. The vessel 30 has a vessel opening 34 at an upper portion where a vessel neck 33 extends from a vessel shoulder 32. At the vessel neck 33 or the vessel shoulder 32, a vessel inside indent 42 can be formed on the vessel inside side wall 35.

The lid 20 fits over the vessel opening 34. The lid 20 is formed of a lid frame 47 with some moving mechanical components mounted within the lid frame 47. The lid frame has an upper body 21 joined to a lower body 22 at a body junction 23. The upper body 21 includes a lid hook handle 24 having a latch gate 44 mounted to a latch gate hinge 25. The lid 20 also has a spindle button 26 to the upper body 21. The spindle button 26 has a spindle button plug 27 on an underside of the spindle button 26. The spindle button 26 is preferably reciprocally mounted and moves up and down without rotating on the upper body 21. An insulated button cavity 45 can be formed between the spindle button 26 and the spindle button plug 27. The spindle button actuates an actuator gear 43 in an up-and-down motion. The spindle button 26 rotates the actuator gear 43. The actuator gear 43 moves up and down in a reciprocal motion and has a spring retainer 46 for retaining a helical spring that pushes the actuator gear 43 and the spindle button 26 upwardly in an upward bias.

The lower body 22 of the lid 20 receives the spindle body 41. The spindle body 41 has a pair of locking arms 40 extending laterally from the spindle body 41. The locking arms 40 engaged to the vessel inside indents 42 of the vessel inside side wall 35. The actuator gear 43 is coaxially mounted to abut the spindle body 41. The spindle body 41 is biased upwardly by the helical spring that pushes upwardly against the spring retainer 46 and pushes downwardly on a lower wall of the lower body 22. Thus, the spindle body 41 reciprocates upwardly and downwardly for locking and unlocking the locking arms that form a part of the locking mechanism 28.

Figure 3:
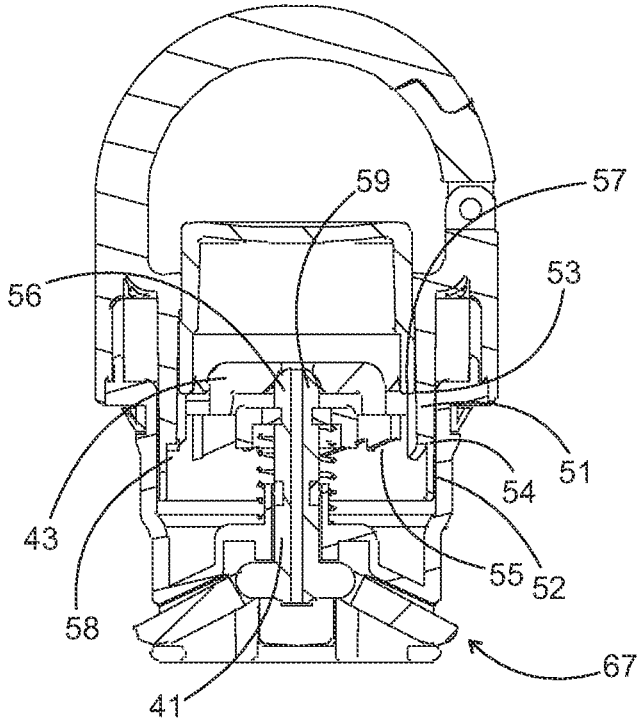
FIG. 3 is a cross-section diagram of the lid in a disengaged position.
Figure 4:
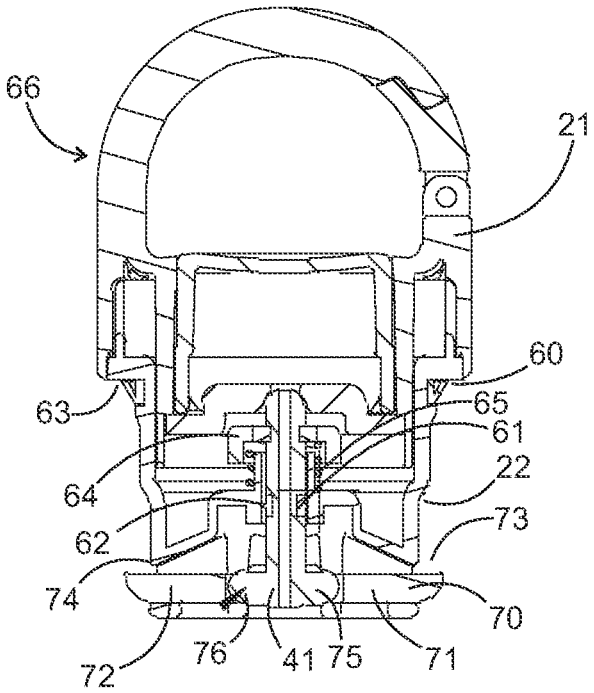
FIG. 4 is a cross-section diagram of the lid in an engaged position.

As seen in FIGS. 3 and 4, the actuator gear 43 includes an actuator gear body 50 from which angled teeth 55 extend. The angled teeth 55 engage selectively into upper slots 51 and lower protrusions 52. The actuator gear body 50 rotates in a clockwise or counterclockwise direction by one step for each button push. Each button push rotates the actuator gear body 50 from a locked position to an unlocked position. The locked position of the actuator gear body occurs when the actuator gear 43 engages to the upper slots 51, and the unlocked position of the actuator gear body occurs when the actuator gear 43 engages to the lower protrusions 52. The upper slots 51 correspond to an upper engagement 53, and the lower protrusions correspond to a lower engagement 54. The upper slots 51 can alternate with the lower engagement 54 so that a button push toggles the mode of a position of the actuator gear 43.

When the actuator gear 43 changes mode from an engaged or locked position to a disengaged or unlocked position, the actuator gear 43 travels between an upper position and a lower position. The actuator gear 43 has an upper position when it engages to the upper engagement 53, and a lower position when it engages with the lower engagement 54. The gear indent 56 is formed on the actuator gear body 50 and the gear indent 56 receives the spindle body upper tip 59. The upper position of the actuator gear 43 corresponds to a disengaged position 67 of the spindle body 41. The lower position of the actuator gear 43 corresponds to an engaged position 66 of the spindle body 41.

During use, the button is in engaged position in a downward location and the user can disengage the button when the user presses the button downwardly and then releases the button. The user releases the actuator gear 43 from the lower engagement 54 so that the actuator gear rotates one step and engages to the upper engagement 53. The actuator gear 43 moves upwardly which moves the spindle body 41 upwardly. The spindle body 41 moving upwardly moves the locking arms into the disengaged position 61. The helical spring pushes the spindle body upper tip 59 up against to the gear indent 56 which pushes the button into the upward disengaged position.

As seen in FIG. 4, the button is pushed back into the engaged position 66. In the engaged position, the button is in a downward location which is because the actuator gear 43 is engaged to the lower engagement 54. The actuator gear alternates between the upper engagement 53 and the lower engagement 54 because the upper slots 51 are alternated with the lower protrusions 52. As seen in FIG. 3, the upper slots 51 are higher than the lower protrusions 52 so that they allow the gear to rise to a greater height. They can both start from the same lower location. An angled tooth 55 on the actuator gear engages to a button tooth 88 of the button as seen on FIG. 5. The button tooth 88 of the button is downwardly facing for engaging the upwardly facing angled tooth 55. The lower protrusion tooth 58 can promote the actuator gear 43 to rotate a step. The contact surfaces of the button, the actuator gear, the upper engagement, and the lower engagement are preferably angled to each other so that the button reciprocation leads to a step by step rotation of the actuator gear body 50 and the angled teeth 55 of the gear.

As seen in FIG. 4, the engaged position 66 seals the vessel 30. The gasket 60 on the upper body is mounted in the gasket notch 63. Similarly, a spindle seal notch 62 receives the spindle seal 61 on the spindle body 41. The two seals prevent liquid from leaking out of the container. The helical spring 65 is compressed in the engaged position 66.

The locking arms 70 may include a first locking arm 71 and a second locking arm 72. Additionally, a third or fourth locking arm can be implemented. The first locking arm 71 is jointed to the spindle body 41 at a first locking arm pivot 75, and the second locking arm 72 is jointed to the spindle body 41 at the second locking arm pivot 76. The first locking arm pivot and the second locking arm pivot are preferably integrally formed to the spindle body 41 so that they reciprocate upwardly and downwardly with the pressing of the button.

The first locking arm 71 extends from a first locking arm opening 73, and a second locking arm 72 extends from a second locking arm opening 74. The locking arm openings define a range of motion for the locking arms so that they pivot and engage and disengage from the inside side wall of the vessel.

Figure 5:
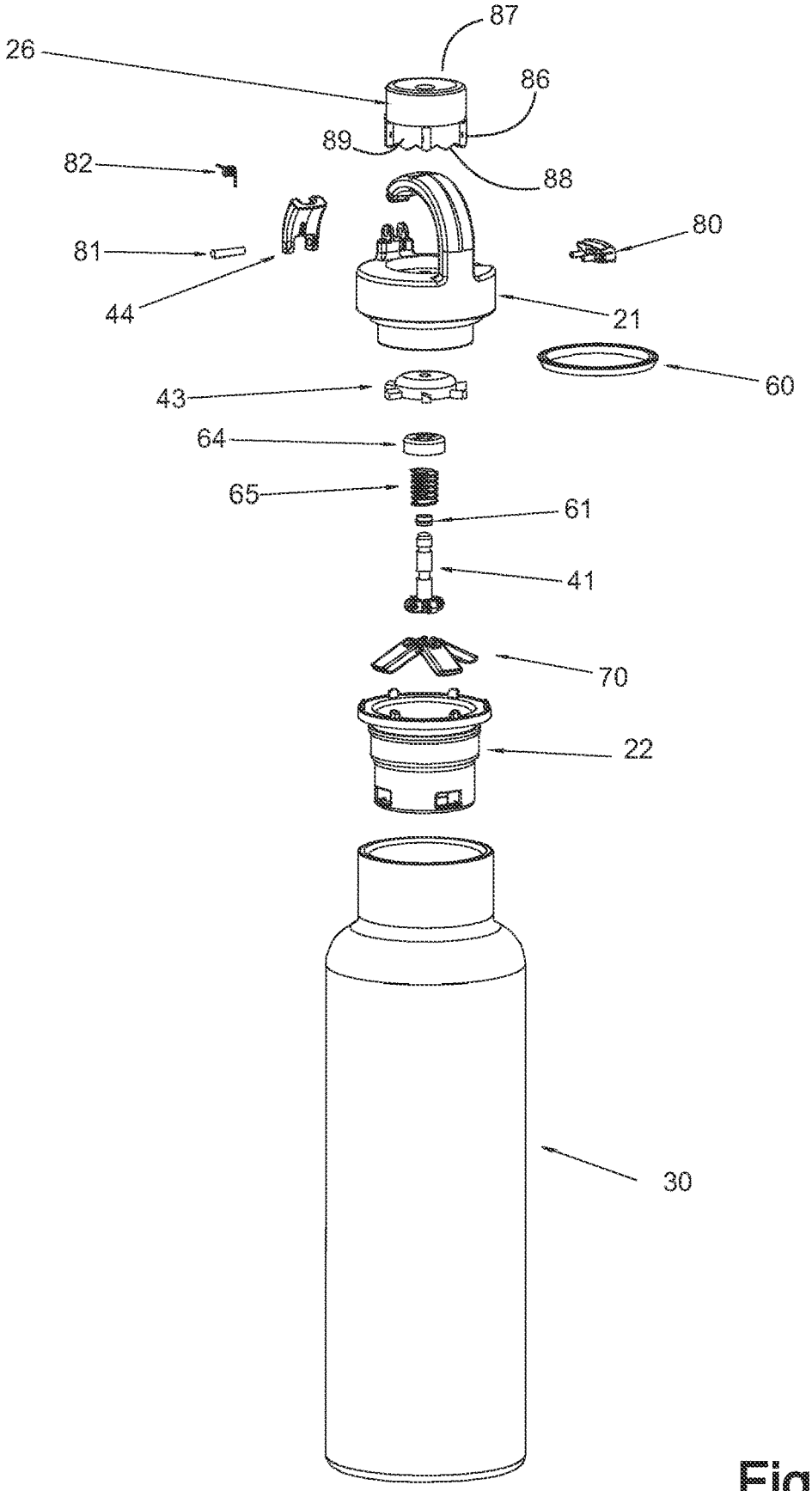
FIG. 5 is an exploded view diagram showing assembly of the present invention.
Figure 6:
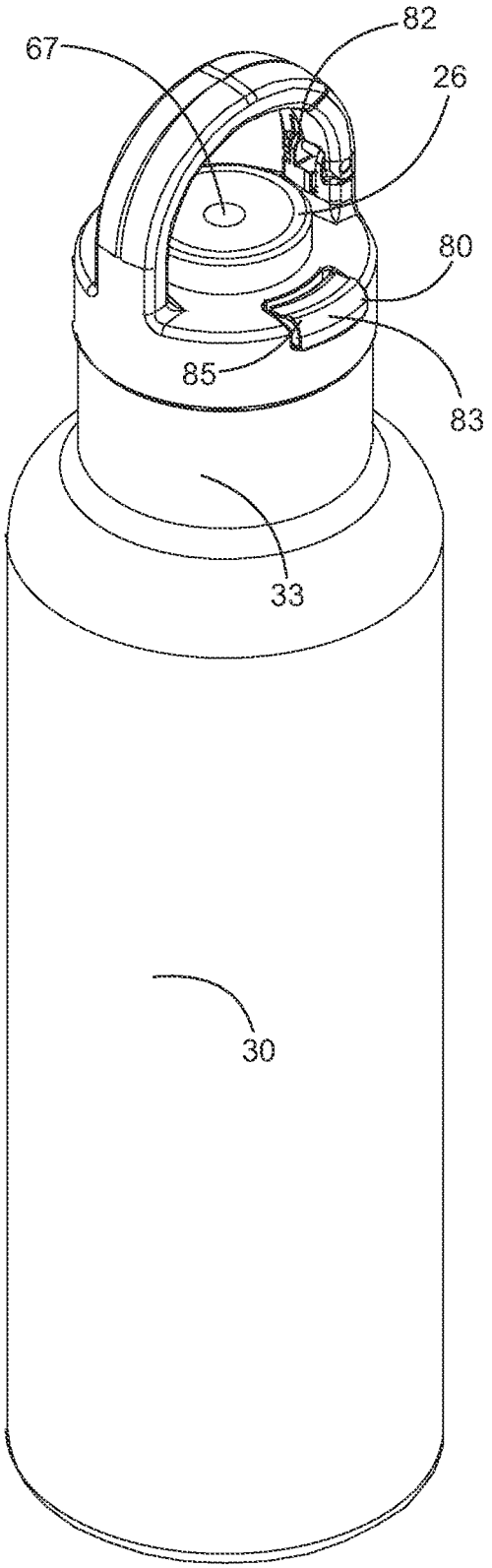
FIG. 6 is a diagram showing the locking body in an unlocked position.
Figure 7:
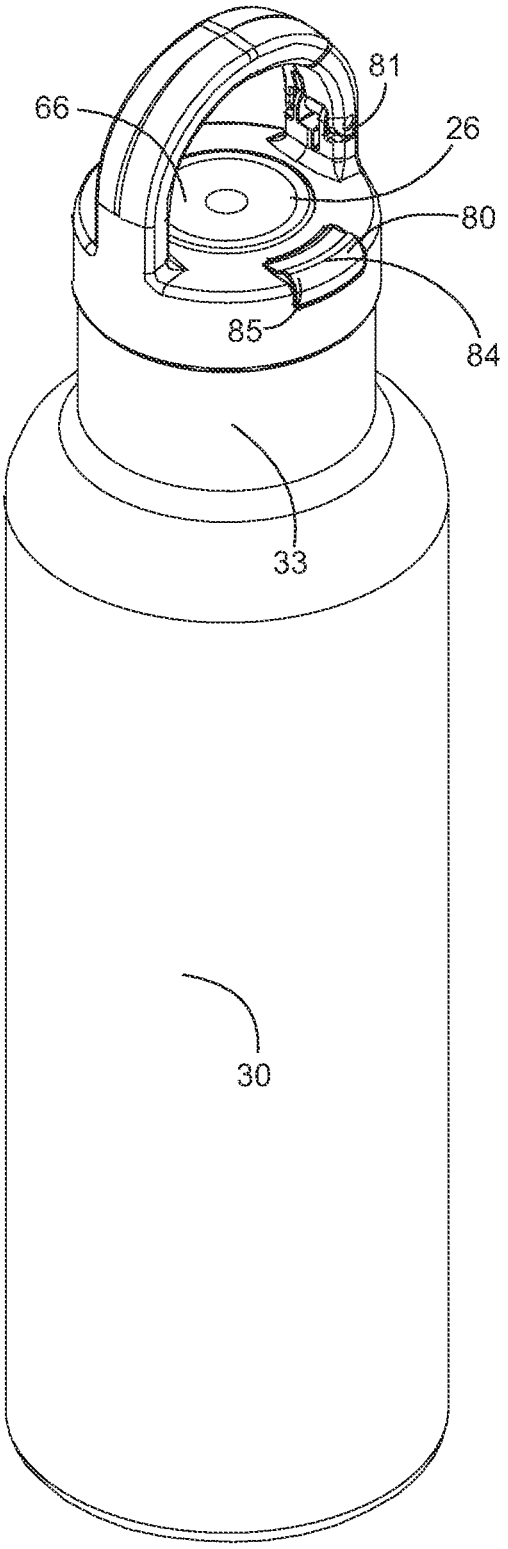
FIG. 7 is a diagram showing the locking body in a locked position.

As seen in FIGS. 5 and 6, an exploded view shows assembly of the present invention with the spindle button 26 having a button top 87 oriented upwardly. The spindle button vertical guides 86 can be depressions or protrusions that engage to vertical depressions or protrusions formed in the upper bodies 21. The spindle button vertical guides 86 are preferably protrusions. The spindle button vertical guides 86 maintain the up-and-down movement of the spindle button 26 without allowing the button to rotate. The button teeth 88 alternate with the button notches 89. Each button tooth 88 has a button notch 89 to the left and right of the button tooth 88, and each button notch 89 has a button tooth 88 to the left and right of the button notch 89. Each button tooth 88 and button notch 89 face downwardly to engage the actuator gear 43. The actuator gear 43 has upwardly facing angled teeth to allow rotation of the actuator gear 43 by one step each time the spindle button for 26 is depressed.

The upper body 21 receives the button. Additionally, a latch gate 44 can be mounted on a hinge pin 81 with a torsion spring 82 wrapped around the inch pin 81 so that the latch gate 44 allows a carabiner type connection to the lid hook handle 24. The gasket 60 is pressed to the lower portion of the upper body at the gasket notch 63 and the gasket 60 can be a silicone gasket having a trapezoidal cross-section. The lower body 22 can be friction fit or pressed into the upper body 21 at locking tabs extending upwardly from the lower body 22 into a locking groove formed on a lower portion of the upper body 21. The actuator gear 43 is mounted coaxially to the spindle button 26. The spring retainer 64 is mounted to a lower surface of the actuator gear 43 and a helical spring 65 is mounted between the lower body 22 and the spring retainer 64. The spindle seal 61 is mounted to the spindle body 41 and the locking arms 70 are jointed to the lower portion of the spindle body 41.

When the insulated locking lid is engaged to the beverage container, a user may desire to use the spring clip function. To prevent accidental opening, an optional locking body 80 can lock the button in a lower position. The locking body 80 has a locked position 84 and an unlocked position 83. A locking body grip 85 can provide a handle for sliding the locking body 80 between the locked position 84 and the unlocked position 83. The locking body 80 may have a protrusion such as a pair of prongs that extend into protrusion receiving openings formed on a side wall portion of the spindle button 26.

Figure 8:
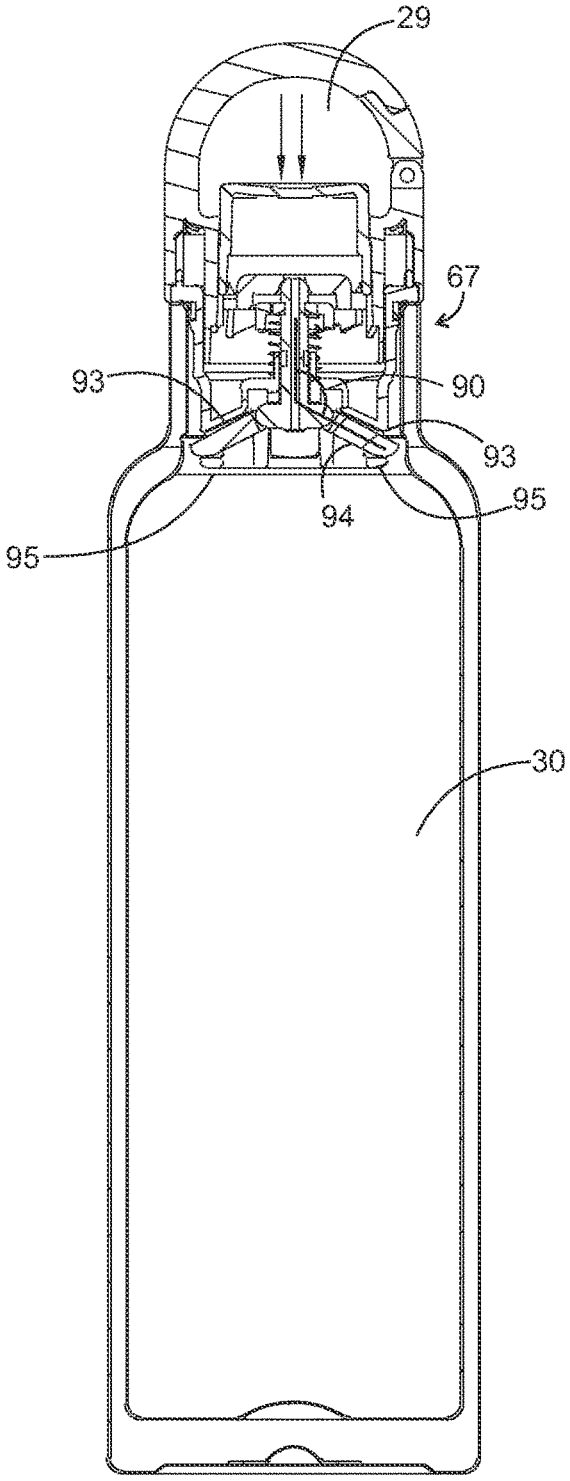
FIG. 8 is a cross-section diagram of the lid showing the locking arm angle.
Figure 9:
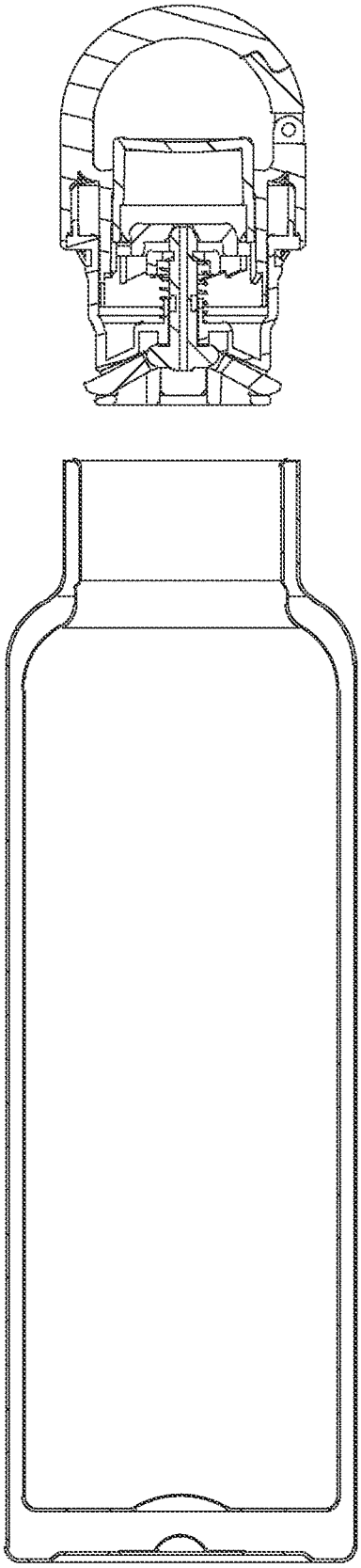
FIG. 9 is a cross-section diagram of the lid showing removal of the lid from the vessel.

As seen in FIGS. 8 and 9, the locking arms 70 have a locking arm angle 90 defined between the spindle body and the locking arms. The locking arm angle 90 is controlled by a lower body lower portion 91 that acts as a lower body lower angle retainer 95. The lower body lower angle retainer 95 cooperates with the lower body upper angle retainer 93 for maintaining an angle of the locking arms 70. The locking arm openings, namely the first locking arm opening 73 and the second locking arm opening 74 can provide a structure for the lower body upper angle retainer 93, and the lower body lower angle retainer 95. For example, an upper portion of the first locking arm opening 73 can be the lower body upper angle retainer 93, and a lower portion of the first locking arm opening 73 can be the lower body lower angle retainer 95. The locking mechanism angled position 94 corresponds to the unlocked position of the locking arms.

The lower body further includes a lower body spring retainer 92 that can be formed around a horizontal internal rib that forms a platform with an opening for receiving the spindle body. The lower body can be formed as a cup-shaped member with platform shaped lower portion that is angled at the edges and raised and flat in the center. The upper body and the lower body can be integrally formed into a single lid frame such as by 3-D printing.

Figure 10:
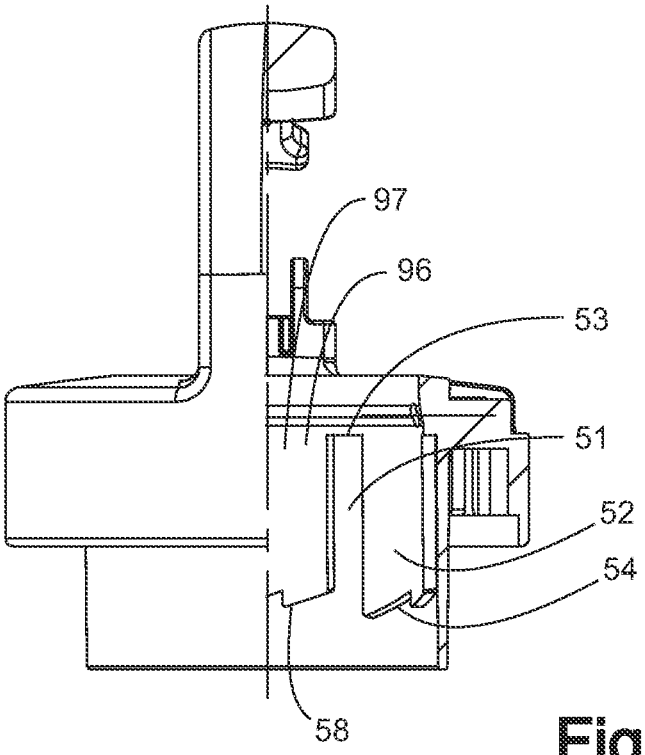
FIG. 10 shows a partial cross-section diagram of the upper body of the lid.
Figure 11:
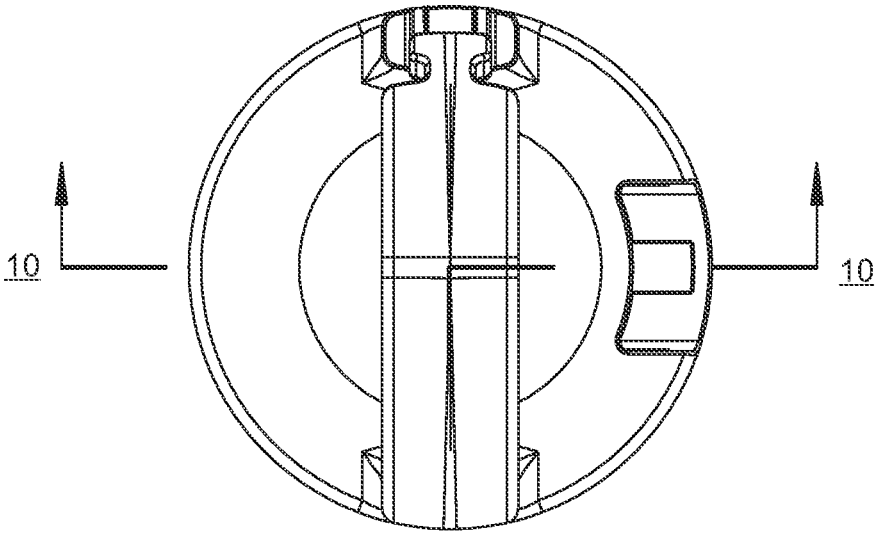
FIG. 11 shows the cross-section location of FIG. 10.

As seen in FIG. 10, the inside surface of the upper body 96 forms a button receiving opening 97. The inside surface of the upper body 96 has upper slots 51, lower slots 52, lower engagements 54, upper engagements 53, lower slot teeth 58 formed for reciprocally receiving the rotating gear. The internal features on the inside surface of the upper body 96 are preferably formed by plastic injection molding.

The invention claimed is:

1. A vessel with a locking lid comprising:

a. a spindle button, wherein the spindle but has downwardly facing button teeth;

b. a lid frame, wherein the lid frame receives the spindle button in a vertical sliding configuration;

c. an actuator gear, wherein the actuator gear is mounted under the spindle button in the lid frame, wherein the actuator gear engages the downwardly facing button teeth, wherein the spindle button is configured to move the actuator gear by one step when the spindle button is pressed down;

d. a lid frame inside surface, wherein the lid frame inside surface has an upper engagement and a lower engagement, wherein the actuator gear is configured to alternate between the upper engagement and the lower engagement when the actuator gear moves by one step;

e. a spindle body, wherein the spindle body abuts the actuator gear, wherein the spindle body is biased upwardly against the actuator gear;

f. a first locking arm, wherein the first locking arm is mounted to the spindle body at a first locking arm pivot formed on the spindle body; and a second locking arm, wherein the second locking arm is mounted to the spindle body at a second locking arm pivot formed on the spindle body;

g. a spring biasing the spindle body upwardly; and h. a vessel, wherein the vessel has a sidewall, wherein the vessel has a vessel inside indent formed on the vessel side wall, wherein the vessel inside indent receives the first locking arm and the second locking arm when the first locking arm and the second locking arm are in an engaged position, wherein the first locking arm and the second locking arm also have a disengaged position retracted away from the vessel inside indent.

2. The vessel with a locking lid of claim 1, wherein the upper engagement is formed as a slot, and the lower engagement is formed as a protrusion, wherein the actuator gear selectively engages the slot and protrusion, wherein the actuator gear engages the slot in the disengaged position, and wherein the actuator gear engages the protrusion in the engaged position.

3. The vessel with a locking lid of claim 1, wherein the lid frame further includes an upper body and a lower body, wherein the upper body is connected to the lower body at a body junction.

4. The vessel with a locking lid of claim 1, wherein the lid frame has a first locking arm opening and a second locking arm opening, wherein the first locking arm opening receives the first locking arm, and wherein the second locking arm opening receives the second locking arm.

5. The vessel with a locking lid of claim 1, wherein the lid frame has a lower body lower angle retainer and a lower body upper angle retainer, wherein the lower body upper angle retainer defines a first locking arm angle when the locking arms are in a disengaged position, wherein the lower body lower angle retainer defines a second locking arm angle when the locking arms are in an engaged position.

6. The vessel with a locking lid of claim 1, further including a spring retainer mounted to the spindle body, wherein the spring retainer retains an upper end of the spring, wherein the spring is a helical spring wrapped around the spindle body, wherein the spindle body is elongated, and wherein the lid frame retains a lower end of the spring, wherein the spring retainer is mounted below the actuator gear, wherein the spring biases the spring retainer upwardly, which biases the spindle body upwardly, which biases the actuator gear upwardly, which biases the button upwardly.

7. The vessel with a locking lid of claim 6, wherein the upper engagement is formed as a slot, and the lower engagement is formed as a protrusion, wherein the actuator gear selectively engages the slot and protrusion, wherein the actuator gear engages the slot in the disengaged position, and wherein the actuator gear engages the protrusion in the engaged position.

8. The vessel with a locking lid of claim 6, wherein the lid frame further includes an upper body and a lower body, wherein the upper body is connected to the lower body at a body junction.

9. The vessel with a locking lid of claim 6, wherein the lid frame has a first locking arm opening and a second locking arm opening, wherein the first locking arm opening receives the first locking arm, and wherein the second locking arm opening receives the second locking arm.

10. The vessel with a locking lid of claim 6, wherein the lid frame has a lower body lower angle retainer and a lower body upper angle retainer, wherein the lower body upper angle retainer defines a first locking arm angle when the locking arms are in a disengaged position, wherein the lower body lower angle retainer defines a second locking arm angle when the locking arms are in an engaged position.

11. The vessel with a locking lid of claim 6, wherein the upper engagement is formed as a slot, and the lower engagement is formed as a protrusion, wherein the actuator gear selectively engages the slot and protrusion, wherein the actuator gear engages the slot in the disengaged position, and wherein the actuator gear engages the protrusion in the engaged position, wherein the lid frame further includes an upper body and a lower body, wherein the upper body is connected to the lower body at a body junction, wherein the lid frame has a first locking arm opening and a second locking arm opening, wherein the first locking arm opening receives the first locking arm, and wherein the second locking arm opening receives the second locking arm, wherein the lid frame has a lower body lower angle retainer and a lower body upper angle retainer, wherein the lower body upper angle retainer defines a first locking arm angle when the locking arms are in a disengaged position, wherein the lower body lower angle retainer defines a second locking arm angle when the locking arms are in an engaged position.

12. The vessel with a locking lid of claim 11, further including a gasket, wherein the gasket is mounted on a gasket notch, wherein the gasket notch is formed on the lid frame; and further including a spindle seal, wherein the spindle seal is mounted to a spindle seal notch, wherein the spindle seal notch is formed on the spindle.

13. The vessel with a locking lid of claim 11, wherein the lid frame further includes a lid hook handle, wherein the lid hook handle has a latch gate, wherein the latch gate is pivotally mounted to the lid frame, wherein the lid hook handle is formed above the spindle button.

14. The vessel with a locking lid of claim 11, wherein the spindle button further includes a spindle button plug inserted into an underside of the spindle button to form an insulated button cavity between the spindle button plug and a button top of the spindle button.

15. The vessel with a locking lid of claim 11, wherein the protrusion has lower protrusion teeth for retaining angled teeth of the actuator gear.

16. The vessel with a locking lid of claim 11, wherein the vessel is a double wall vessel having a vessel inside side wall inside a vessel outside side wall, with a vessel side wall cavity between the vessel inside side wall and the vessel outside side wall, wherein the vessel inside indent is formed on the vessel inside side wall.

17. The vessel with a locking lid of claim 11, wherein the vessel has a shoulder and an elongated neck, wherein the lid frame fits within the elongated neck at the vessel opening.

* * * * *